US009130276B2

(12) United States Patent
Yanagi et al.

(10) Patent No.: US 9,130,276 B2
(45) Date of Patent: Sep. 8, 2015

(54) ANTENNA DEVICE

(71) Applicant: FUJITSU COMPONENT LIMITED, Tokyo (JP)

(72) Inventors: Masahiro Yanagi, Tokyo (JP); Hideaki Yoda, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 178 days.

(21) Appl. No.: 14/088,575

(22) Filed: Nov. 25, 2013

(65) Prior Publication Data

US 2014/0168028 A1 Jun. 19, 2014

(30) Foreign Application Priority Data

Dec. 18, 2012 (JP) ..... 2012-276101

(51) Int. Cl.

| | |
|---|---|
| ***H01Q 1/38*** | (2006.01) |
| ***H01Q 1/48*** | (2006.01) |
| ***H01Q 1/24*** | (2006.01) |
| ***H01Q 5/378*** | (2015.01) |
| *H01Q 9/30* | (2006.01) |

(52) U.S. Cl.

CPC ..... *H01Q 1/38* (2013.01); *H01Q 1/243* (2013.01); *H01Q 1/48* (2013.01); *H01Q 5/378* (2015.01); *H01Q 9/30* (2013.01)

(58) Field of Classification Search

USPC ..... 343/700 MS, 833, 848

See application file for complete search history.

(56) References Cited

U.S. PATENT DOCUMENTS

| | | | | |
|---|---|---|---|---|
| 2004/0066341 | A1* | 4/2004 | Ito et al. | 343/702 |
| 2008/0180333 | A1* | 7/2008 | Martiskainen et al. | 343/722 |
| 2010/0103069 | A1* | 4/2010 | Wang et al. | 343/846 |
| 2012/0249386 | A1* | 10/2012 | Yanagi et al. | 343/749 |
| 2013/0044030 | A1* | 2/2013 | Oh | 343/700 MS |
| 2014/0375508 | A1* | 12/2014 | Miyake | 343/700 MS |

FOREIGN PATENT DOCUMENTS

| | | |
|---|---|---|
| JP | 2001-160710 | 6/2001 |

* cited by examiner

*Primary Examiner* — Tan Ho

(74) *Attorney, Agent, or Firm* — IPUSA, PLLC

(57) ABSTRACT

An antenna device includes a substrate; a first ground element that is arranged on the substrate; an antenna element that is arranged on the substrate and extends from its first end positioned near a side edge of the first ground element to its second end positioned away from the side edge; and a non-feed element that is arranged on the substrate, connected to the first ground element, and insulated from the antenna element. The non-feed element extends from its first end portion positioned near the side edge of the first ground element to a bending portion in a direction away from the side edge and extends from the bending portion to its second end portion along the side edge. A portion between the bending portion and the second end portion of the non-feed element intersects with the antenna element.

6 Claims, 12 Drawing Sheets

6mm
7mm
8mm
9mm
10mm
VSWR
5
4
3
2
1
2
2.2
2.4
2.6
2.8
3
3.2
3.4
3.6
3.8
4
FREQUENCY(GHz)

16mm
17mm
18mm
19mm
20mm
VSWR
5
4
3
2
1
2
2.2
2.4
2.6
2.8
3
3.2
3.4
3.6
3.8
4
FREQUENCY(GHz)

1mm
2mm
3mm
4mm
5mm
VSWR
5
4
3
2
1
2
2.2
2.4
2.6
2.8
3
3.2
3.4
3.6
3.8
4
FREQUENCY(GHz)

11mm
12mm
13mm
14mm
15mm
VSWR
5
4
3
2
1
2
2.2
2.4
2.6
2.8
3
3.2
3.4
3.6
3.8
4
FREQUENCY(GHz)

ANTENNA DEVICE

BACKGROUND OF THE INVENTION

1. Field of the Invention

The present invention relates to an antenna device.

2. Description of the Related Art

A wideband array antenna is known that has an inverted-F antenna as a feed element and a non-feed element having a prescribed length erected on a ground plate. In such a wideband array antenna, a part of the non-feed element is disposed at an upper side at a prescribed distance from the feed element, and the respective element lengths of the non-feed element and the feed element are arranged to be different from each other (See e.g., Japanese Laid-Open Patent Publication No. 2001-160710).

It has been difficult to miniaturize antenna devices such as the wideband array antenna described above because of the arrangement of the inverted-F antenna and the non-feed element on the ground plate.

SUMMARY

It is an object of at least one embodiment of the present invention to provide a miniaturized antenna device.

According to an embodiment of the present invention, an antenna device includes a substrate; a first ground element that is arranged on the substrate; an antenna element that is arranged on the substrate and extends from its first end positioned near a side edge of the first ground element to its second end positioned away from the side edge; and a non-feed element that is arranged on the substrate, connected to the first ground element, and insulated from the antenna element. The non-feed element extends from its first end portion positioned near the side edge of the first ground element to a bending portion in a direction away from the side edge and extends from the bending portion to its second end portion along the side edge. A portion between the bending portion and the second end portion of the non-feed element intersects with the antenna element.

According to an aspect of the present invention, a miniaturized antenna device may be provided.

DESCRIPTION OF EMBODIMENTS

In the following, embodiments of the present invention will be described with reference to the accompanying drawings.

Figure 1:
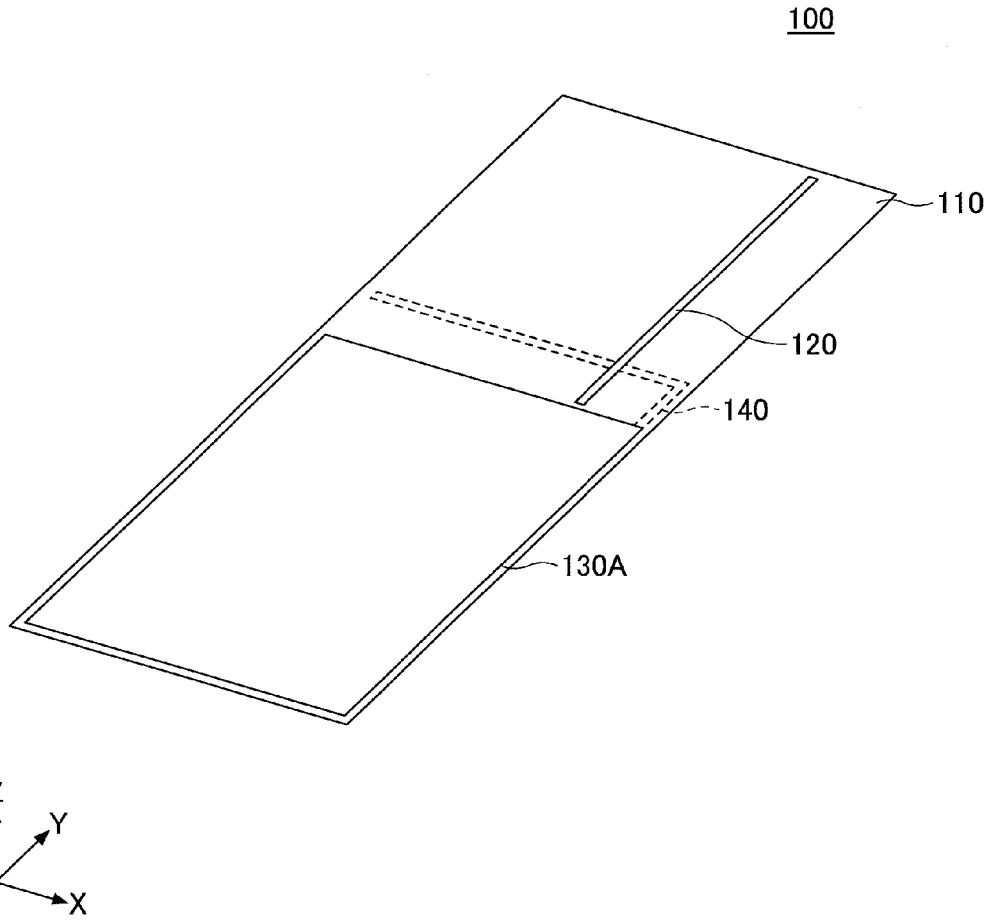
FIG. 1 is a perspective view of an antenna device according to an embodiment of the present invention.
Figure 2B:
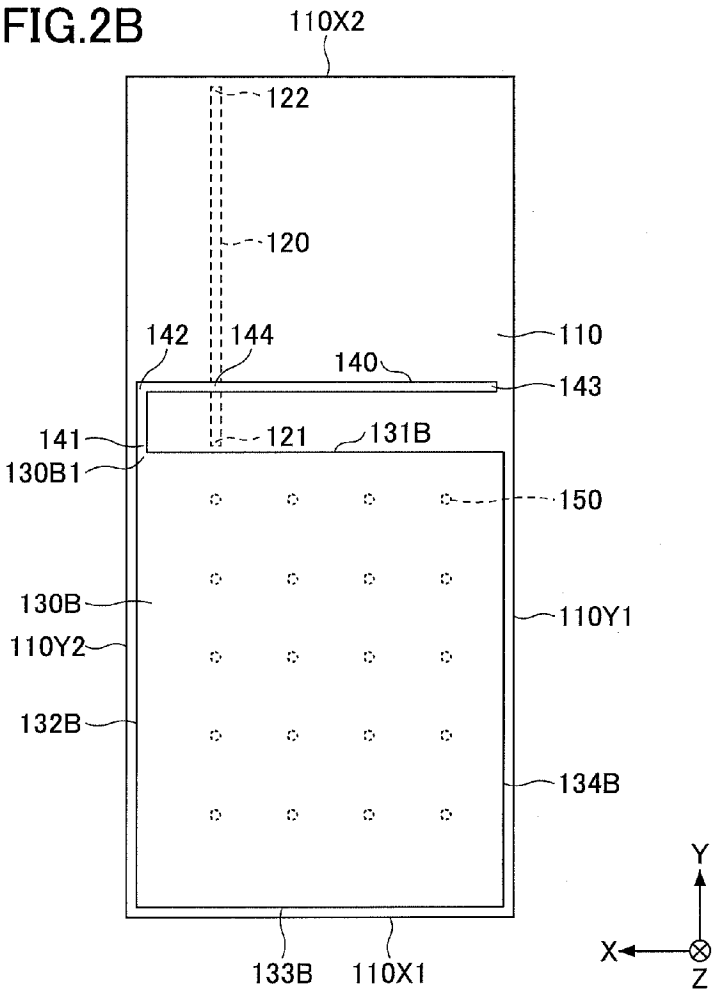
FIGS. 2A and 2B respectively illustrate a front surface and a back surface of the antenna device of the present embodiment.
Figure 2A:
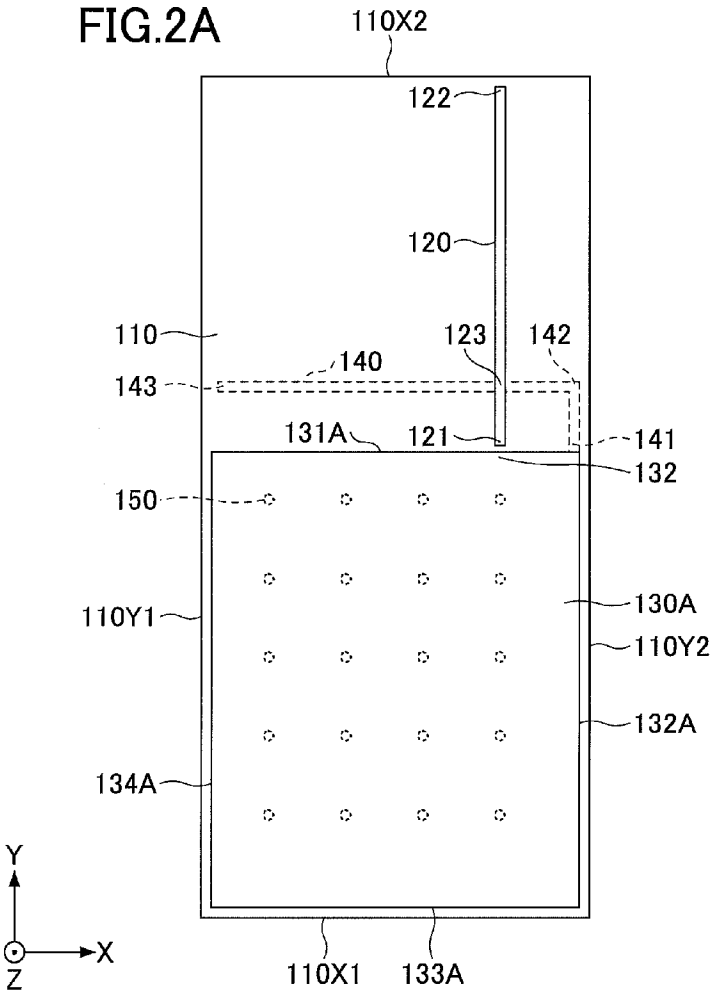

FIG. 1 is a perspective view of an antenna device 100 according to an embodiment of the present invention. FIGS. 2A and 2B respectively illustrate a front surface and a back surface of the antenna device 100. Note that FIGS. 1, 2A, and 2B illustrate the antenna device 100 with respect to an XYZ orthogonal coordinate system.

The antenna device 100 includes a substrate 110, an antenna element 120, ground elements 130A and 130B, and a non-feed element 140.

The substrate 110 may be a printed circuit board that complies with a standard such as FR-4 (Flame Retardant Type 4), for example. Alternatively, the substrate 110 may be a flexible substrate made of a polyimide film, for example.

The substrate 110 has a rectangular shape in plan view with its longer sides extending in the Y-axis direction. Specifically, as illustrated in FIGS. 2A and 2B, the substrate 110 of the present embodiment is arranged into a rectangle having four side edges 110X1, 110X2, 110Y1, and 110Y2.

The antenna element 120 is formed on one surface (front surface illustrated in FIG. 2A) of the substrate 110. A feed point 121 is arranged at one end of the antenna element 120. The feed point 121 is arranged near a side edge 131A of the ground element 130A, which has a rectangular shape in plan view.

The antenna element 120 extends from the feed point 121, which is arranged near the side edge 131A of the ground element 130A, to an end point 122 at the other end of the antenna element 120 located toward the Y-axis positive direction side and away from the side edge 131A.

The antenna element 120 is a monopole antenna that is fed at the feed point 121. The length between the feed point 121 and the end point 122 may be set to $\lambda/4$; i.e., ¼ of the wavelength $\lambda$ at a communication frequency (resonant frequency of the antenna device 100), for example.

However, because the effective length of a monopole antenna may vary depending on factors such as the dielectric constant of the substrate 110, the length of the antenna element 120 (i.e., length between the feed point 121 and the end point 122) may be set to approximately $\lambda/4$ taking into account the dielectric constant of the substrate 110, for example.

The feed point 121 of the antenna element 120 may be fed by connecting the feed point 121 to a cable core of a coaxial cable that is connected to a transceiving terminal of a transceiver, for example. In this case, a shield line of the coaxial cable may be connected to a point of the ground element 130A near the side edge 131A, which is located at the Y-axis negative direction side of the feed point 121, for example. Such a point to which the shield line of the coaxial cable is connected is illustrated as feed point 132 in FIG. 2A. The feed point 132 may be located at a position corresponding to the position of the feed point 121.

Alternatively, instead of feeding the feed point 121 using a coaxial cable, a transceiver may be arranged at the ground element 130A and a transceiving terminal of the transceiver may be connected to the feed point 121, for example. In this case, a ground terminal of the transceiver may be connected to the ground element 130A.

The antenna element 120 intersects with the non-feed element 140 at a point 123 ("intersecting point") between the feed point 121 and the end point 122 in plan view.

The antenna 120 as described above may be fabricated by etching a pattern on a copper foil that is laminated on one surface of the substrate 110, for example. Note that although an exemplary case where the antenna element 120 is made of copper is described below, the antenna element 120 is not limited to copper but may be made of some other type of metal such as aluminum, for example.

The ground element 130A is formed at the Y-axis negative direction side of one surface of the substrate 110 within an area substantially half the size of the entire surface of the substrate 110. The ground element 130A extends along substantially the entire X-axis direction range of the substrate 110 other than the X-axis direction side edges of the substrate 110.

The antenna element 120 extends along the Y-axis direction and may be located at the X-axis positive direction side of the longitudinal central axis of the substrate 110, for example. The position of the antenna element 120 with respect to the X-axis direction is described in detail below.

In FIG. 2B, a corresponding position of the antenna element 120 at the back surface of the substrate 110 is indicated by broken lines.

As described above, the ground element 130A has a rectangular shape in plan view and is arranged at the X-axis negative direction side of one surface (front surface illustrated in FIG. 2A) of the substrate 110. That is, the ground element 130A is arranged into a rectangular shape. Note that the ground element 130A may be an exemplary embodiment of a first ground element or a second ground element.

The ground element 130A includes four side edges 131A, 132A, 133A, and 134A. The side edges 132A, 133A, and 134A extend along the edges of the substrate 110.

The side edge 131A extends across the surface of the substrate 110 in the X-axis direction along a boundary between the area where the ground element 130A is arranged and the area where the ground element 130A is not arranged.

The feed point 132 to which the shield line of a coaxial cable is connected is arranged near the side edge 131A at a position corresponding to the position of the feed point 121. The ground element 130A is connected to the coaxial cable via the feed point 132.

The ground element 130A as described above may be fabricated by etching a pattern on a copper foil that is laminated on one surface of the substrate 110, for example. Note that although an exemplary case where the ground element 130A is made of copper is described below, the ground element 130A is not limited to copper but may be made of some other type of metal such as aluminum, for example.

The ground element 130B is formed on the other surface (back surface shown in FIG. 2B) of the substrate 110 within an area overlapping the area of the ground element 130A in plan view. The ground element 130B may be an exemplary embodiment of the first ground element or the second ground element. That is, when the ground element 130A corresponds to an exemplary embodiment of the first ground element, the ground element 130B may correspond to an exemplary embodiment of the second ground element. On the other hand, when the ground element 130A corresponds to an exemplary embodiment of the second ground element, the ground element 130B may correspond to an exemplary embodiment of the first ground element.

The ground element 130B is connected to the ground element 130A by vias 150 that penetrate through the substrate 110 so that the ground element 130B may be maintained at ground potential. The vias 150 are arranged within the areas where the ground element 130A and the ground element 130B are formed.

The ground element 130B includes four side edges 131B, 132B, 133B, and 134B. The side edges 131B, 132B, 133B, and 134B are respectively arranged at positions overlapping the positions of the side edges 131A, 132A, 133A, and 134A in plan view.

The ground element 130B has a corner portion 130B1 located at the X-axis positive direction side and Y-axis positive direction side of the ground element 130B. An end portion 141 of the non-feed element 140 is connected to the corner portion 130B1. The corner portion 130B1 is located at a point where the side edge 131B and the side edge 132B intersect.

The ground element 130B as described above may be fabricated by etching a pattern on a copper foil that is laminated on the other surface of the substrate 110, for example. Note that although an exemplary case where the ground element 130B is made of copper is described below, the ground element 130B is not limited to copper but may be made of some other type of metal such as aluminum, for example. Also, in certain preferred embodiments, the ground element 130B and the non-feed element 140 may be fabricated at the same time.

As illustrated in FIG. 2B, the non-feed element 140 is an L-shaped non-feed element having the end portion 141 connected to the corner portion 130B1 of the ground element 130B.

The non-feed element 140 includes the end portion 141 as one end of the non-feed element 140; a portion extending in the Y-axis direction from the end portion 141, to a bending portion 142 at which the non-feed element 140 bends at a 90-degree angle; a portion extending in the X-axis direction from the bending portion 142 to an end portion 143 along the side edge 131B; and the end portion 143 as the other end of the non-feed element 140. The end portion 143 is located near the side edge 110Y1.

The non-feed element 140 is connected to the ground element 130B and does not directly receive power. Thus, the non-feed element 140 may be regarded as a parasitic element.

The length between the bending portion 142 and the end portion 143 of the non-feed element 140 may be set to $\lambda/4$; i.e., ¼ of the wavelength $\lambda$ of the communication frequency (resonant frequency of the antenna device 100), for example.

However, because the length of the non-feed element 140 may depend on factors such as the dielectric constant of the substrate 110, the length between the bending portion 142 and the end portion 143 may be set to approximately $\lambda/4$ taking into account the dielectric constant of the substrate 110, for example.

The portion between the bending portion 142 and the end portion 143 of the non-feed element 140 intersects with the antenna element 120. In the example illustrated in FIGS. 2A and 2B, the portion between the bending portion 142 and the end portion 143 of the non-feed element 140 intersects with the antenna element 120 at a right angle. In FIG. 2B, the non-feed element 140 intersects with the antenna element 120 at point 144.

Note that the angle at which the portion between the bending portion 142 and the end portion 143 of the non-feed element 140 intersects with the antenna element 120 is not limited to a right angle. In FIG. 2A, a corresponding position of the non-feed element 140 at the front surface of the substrate 110 is indicated by broken lines.

In the antenna device 100 having the above-described configuration, the antenna element 120 receives power via the feed point 121 and functions as a monopole antenna.

By coupling the antenna element 120 to the non-feed element 140, a band may be widened at the lower frequency side. That is, by widening the band, favorable antenna characteristics may be obtained at a lower frequency range.

Note that the above-described effect may similarly be obtained even when the length of the antenna element 120 is shortened and a high frequency (resonant frequency) is used.

That is, even when the length of the antenna element 120 is shortened and a high frequency is used, the band may be widened at the lower frequency side and favorable antenna characteristics may be obtained at the frequency used.

By shortening the length of the antenna element 120 as described above, the antenna device 100 may be miniaturized. The resonant frequency used by the antenna element 120 may be set to a suitable frequency according to the intended use of the antenna device 100.

Also, in the antenna device 100 of the present embodiment, the positional relationship between the antenna element 120 and the non-feed element 140 may preferably be arranged in the following manner, for example.

The position of the antenna element 120 with respect to the X-axis is preferably arranged such that the length between intersecting point 123 and the bending porting 143 is equal to $\lambda/20$; i.e., 1/20 of the wavelength $\lambda$ of the communication frequency.

Also, the distance in the Y-axis from the side edge 131B of the ground element 130B (or side edge 131A of the ground element 130A) to the portion between the bending portion 142 and the end portion 143 of the non-feed element 140 is preferably set to $\lambda/20$; i.e., 1/20 of the wavelength $\lambda$ of the communication frequency. In other words, the distance from the end portion 141 to the bending portion 142 of the non-feed element 140 is preferably set to $\lambda/20$.

For example, in a case where the communication frequency is set to 2.45 GHz for use in a wireless LAN (local area network), the length between the feed point 121 and the end point 122 of the antenna element 120 may be arranged to be 20 mm so that the above value $\lambda/20$ may be 4 mm.

Also, the lengths of the ground elements 130A and 130B in the X-axis direction may be 20 mm, and the lengths of the ground elements 130A and 130B in the Y-axis direction may be 25 mm.

Also, the respective lengths between the side edges 132A, 133A, and 134A of the ground element 130A and the side edges 110Y2, 110X1, and 110Y1 of the substrate 110 (i.e., margins between the edges of the substrate 110 and the edges of the ground element 130A where the ground element 130A is not arranged) may be set to 0.5 mm, for example. The same arrangements may be made for the ground element 130B.

Although the line width of the antenna element 120 and the line width of the non-feed element 140 may be set to suitable values in view of various factors such as the communication characteristics of the antenna device 100, in one example, the line widths may be set to 0.5 mm.

In the following, referring to FIGS. 3-11, VSWR (voltage standing-wave ratio) characteristics of the antenna device 100 are described in various cases where the dimensions of its components are changed.

Figure 3:
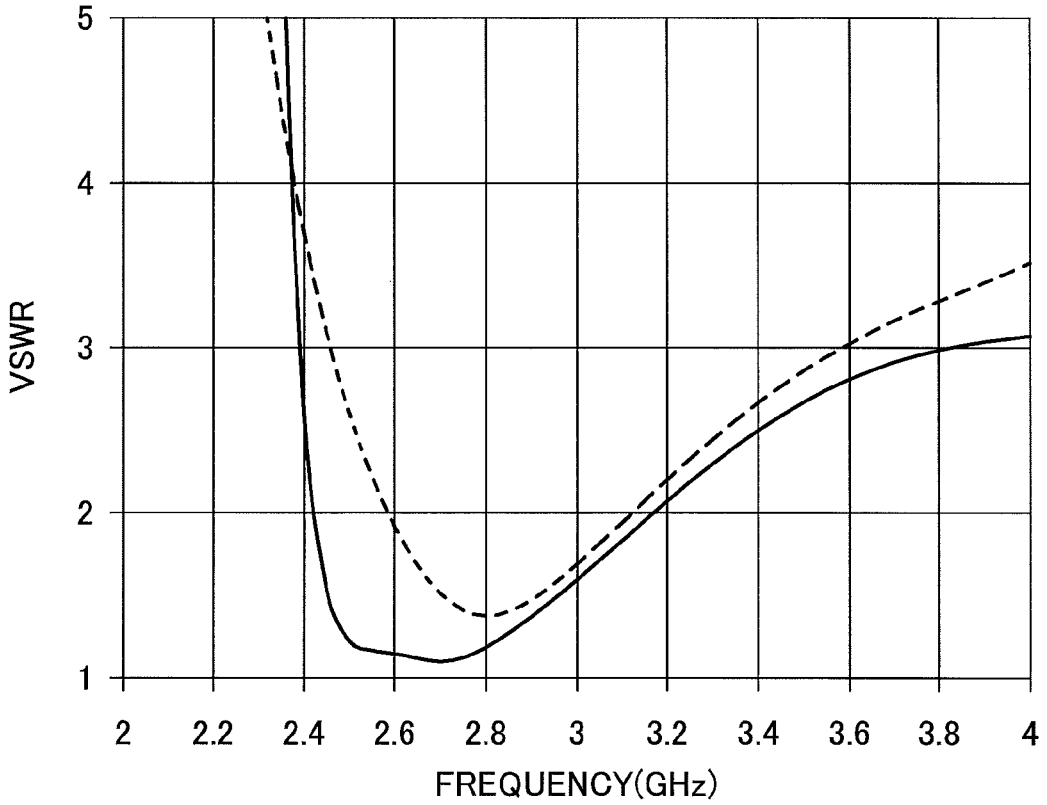
FIG. 3 is a graph illustrating VSWR characteristics of the antenna device of the present embodiment and VSWR characteristics of an antenna device without a non-feed element.

FIG. 3 is a graph illustrating VSWR characteristics of the antenna device 100 of the present embodiment and VSWR characteristics of an antenna device that does not include the non-feeding element 140 of the antenna device 100.

In FIG. 3, the VSWR characteristics of the antenna device 100 of the present embodiment are represented by a solid line, and the VSWR characteristics of the antenna device without the non-feed element 140 are represented by a broken line.

The VSWR characteristics represented by the solid line in FIG. 3 are obtained in a case where the dimensions of the antenna device 100 of the present embodiment were set up as follows:

Length between intersecting point 123 and the bending portion 142: $\lambda/20$ (4 mm)

Distance in the Y-axis direction from the side edge 131B of the ground element 130B to the portion between the bending portion 142 and the end portion 143 of the non-feed element 140: $\lambda/20$ (4 mm)

Length between the feed point 121 and the end point 122 of the antenna element 120: 20 mm Lengths of the ground elements 130A and 130B in the X-axis direction: 20 mm Lengths of the ground elements 130A and 130B in the Y-axis direction: 25 mm The antenna device without the non-feed element 140 has other components of the antenna device 100 (i.e., components other than the non-feed element 140) with the same dimensions.

That is, the difference in the VSWR characteristics represented by the solid line and the broken line in FIG. 3 may be solely attributed to the presence or absence of the non-feed element 140. Note that the VSWR characteristics illustrated in FIG. 3 were obtained through electromagnetic simulation.

As illustrated by the solid line in FIG. 3, in the antenna device 100 of the present embodiment, favorable VSWR characteristics of 2.0 or less can be obtained at a frequency range from approximately 2.43 GHz to approximately 3.15 GHz. The minimum value of the VSWR is approximately 1.1, and the VSWR is approximately 1.2 at 2.45 GHz.

On the other hand, as illustrated by the broken line in FIG. 3, in the antenna device without the non-feed element 140, VSWR characteristics of 2.0 or less can be obtained at a frequency range from approximately 2.57 GHz to approximately 3.1 GHz. The minimum value of the VSWR is approximately 1.4, and the VSWR is approximately 3.2 at 2.54 GHz.

As can be appreciated from above, the band of the antenna device 100 may be widened by providing the non-feed element 140.

Also, when the non-feed element 140 is added, the band at which the VSWR equals its minimum value is shifted toward the lower frequency side. This may be attributed to band widening at the lower frequency side as a result of coupling the antenna element 120 to the non-feed element 140.

On the other hand, the VSWR characteristics may shift toward the higher frequency side when the length of the antenna element 120 is shortened.

Thus, by adding the non-feed element 140 to shift the VSWR characteristics toward the lower frequency side and shortening the length of the antenna element 120, VSWR characteristics at the desired frequency of 2.45 GHz may be improved and the antenna device 100 may be miniaturized. Note that the VSWR characteristics may be affected by the length of the non-feed element 140 in a similar manner as described in detail below.

As can be appreciated from above, the antenna device 100 including the non-feed element 140 may be miniaturized by shortening the antenna element 120.

In the following, referring to FIGS. 4A-5D, VSWR characteristics of the antenna device 100 are described in various cases where the position of the antenna element 120 is shifted (changed) in the X-axis direction.

FIGS. 4A-4F are perspective views of the antenna device 100 having the antenna element 120 arranged at different positions in the X-axis direction.

Note that shifting the position of the antenna element 120 in the X-axis direction corresponds to changing the length between the intersecting point 123 and the bending portion 142. Also, because intersecting point 123 (see FIG. 2A) and point 144 (see FIG. 2B) are located at the same position with respect to the X-axis direction, altering the length between intersecting point 123 and the bending portion 142 corresponds to altering the length between point 144 and the bending portion 142.

Figure 4A:
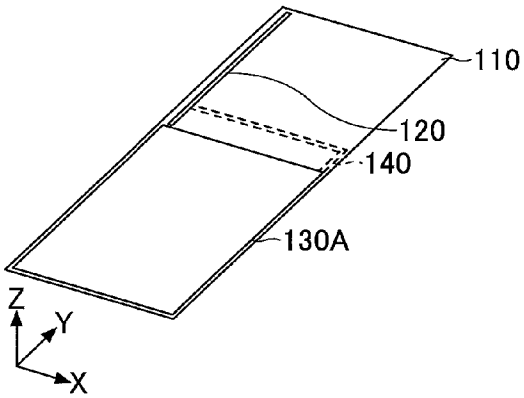
FIGS. 4A-4F are perspective views of the antenna device of the present embodiment having an antenna element arranged at different positions.
Figure 4B:
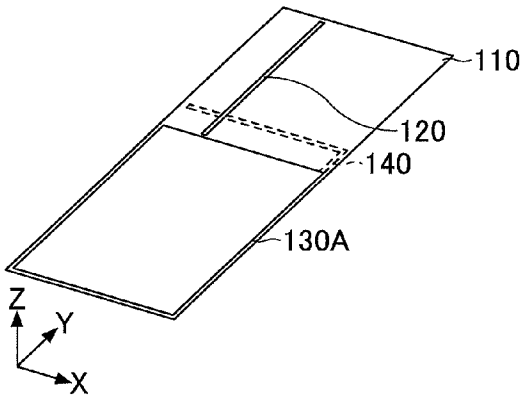
Figure 4C:
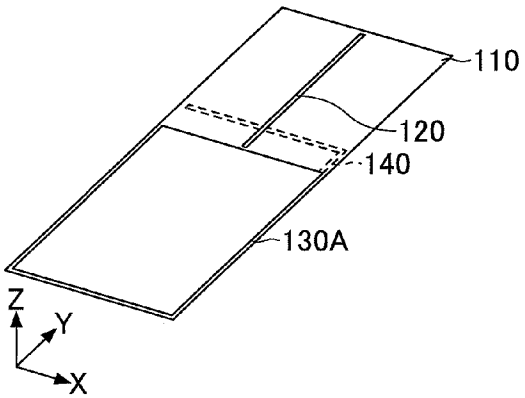
Figure 4D:
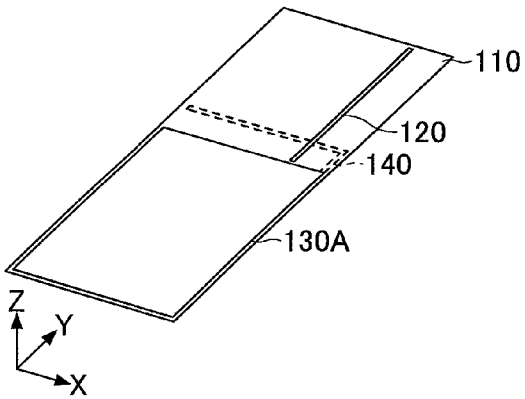

The antenna device 100 as illustrated in FIG. 4D corresponds to the antenna device 100 illustrated in FIG. 1. That is, in FIG. 4D, the length between the intersecting point 123 and the bending portion 142 is λ/20 (4 mm).

In FIG. 4C, the antenna element 120 is shifted in the X-axis negative direction so that the length between intersecting point 123 and the bending portion 142 is λ/8 (10 mm).

In FIGS. 4B and 4A, the antenna element 120 is shifted farther in the X-axis negative direction so that the length between intersecting point 123 and the bending portion 142 is 15 mm and 20 mm, respectively.

Figure 4E:
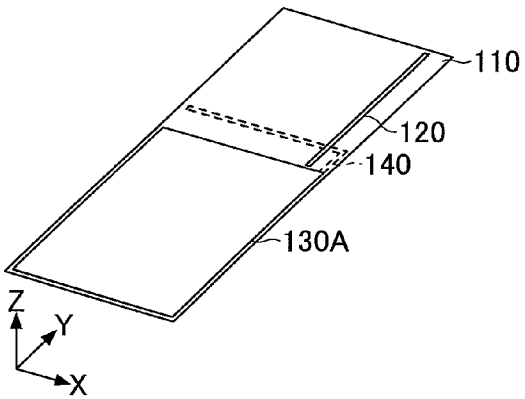
Figure 4F:
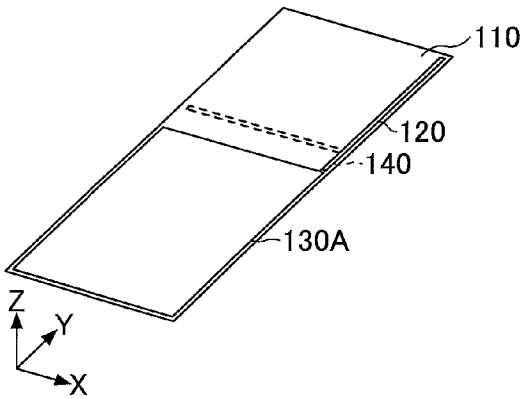

In FIGS. 4E and 4F, the antenna element 120 is shifted in the X-axis positive direction so that the length between intersecting point 123 and the bending portion 142 is 2 mm and 1 mm, respectively.

Figure 5B:
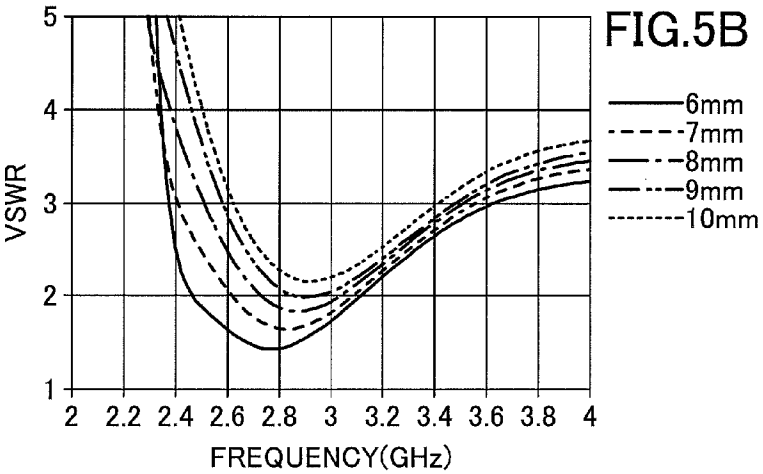
FIGS. 5A-5D are graphs illustrating VSWR characteristics of the antenna device of the present embodiment in various cases where the length between an intersection point and a bending portion of a non-feed element is changed.
Figure 5D:
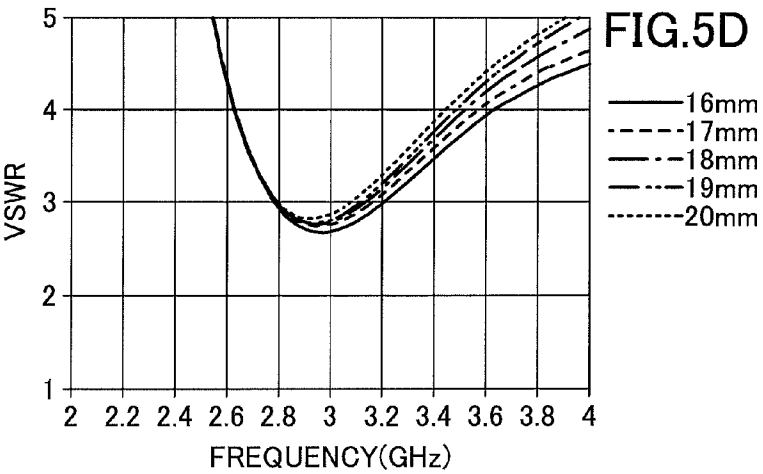
Figure 5A:
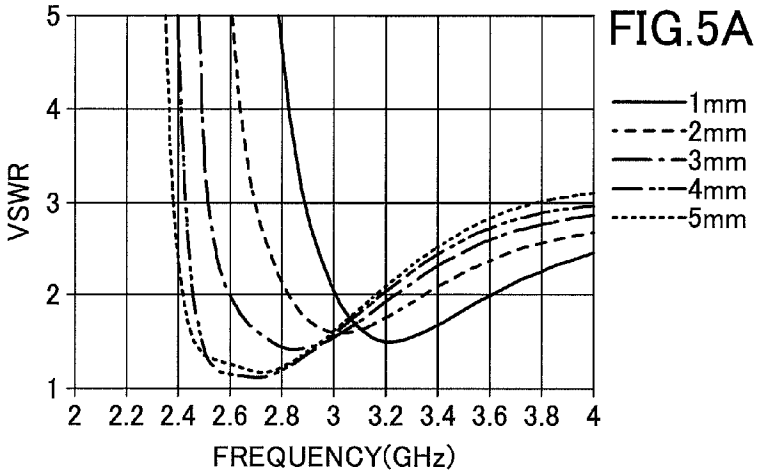
Figure 5C:
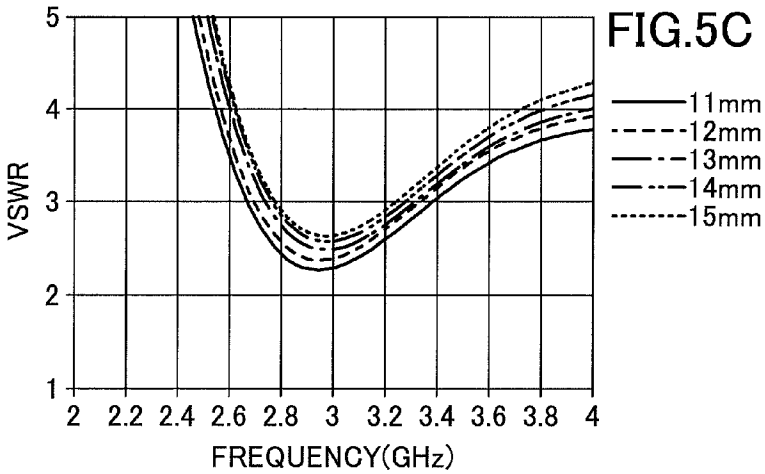

FIGS. 5A-5D are graphs illustrating VSWR characteristics of the antenna device 100 in various cases where the length between intersecting point 123 and the bending portion 142 is incremented by 1 mm from 1 mm to 20 mm. For the sake of improving visibility, illustrations of the VSWR characteristics of the antenna device 100 incremented in the above manner are divided into four separate graphs in FIGS. 5A-5D. That is, FIG. 5A illustrates cases where the length between intersecting point 123 and the bending portion 142 is from 1 mm to 5 mm; FIG. 5B illustrates cases where the length between intersecting point 123 and the bending portion 142 is from 6 mm to 10 mm; FIG. 5C illustrates cases where the length between intersecting point 123 and the bending portion 142 is from 11 mm to 15 mm; and FIG. 5D illustrates cases where the length between intersecting point 123 and the bending portion 142 is from 16 mm to 20 mm.

Upon reviewing the VSWR values at 2.45 GHz in FIGS. 5A-5D, it can be appreciated that favorable VSWR characteristics can be obtained when the length between intersecting point 123 and the bending portion 142 is 4 mm, 5 mm, and 6 mm. Further, of these cases, the band widening effect is greatest when the length between intersecting point 123 and the bending portion 142 is 4 mm.

Note that when the length between intersecting point 123 and the bending portion 142 is 7 mm or more, the VSWR value tends to increase and the band tends to become narrower.

As can be appreciated from the above, by arranging the length between intersecting point 123 and the bending portion 142 to be within a range of 4 mm to 6 mm in the antenna device 100 of the present embodiment, the band may be widened around the desired frequency of 2.45 GHz and favorable VSWR values may be obtained. The above range from 4 mm to 6 mm may be expressed as λ/20 to 3λ/40 using the wavelength λ at the frequency 2.45 GHz, which is approximately 80 mm.

As described above, the VSWR characteristics of the antenna device 100 tend to shift toward the higher frequency side when the length of the antenna element 120 is shortened.

Thus, by arranging the length between intersecting point 123 and the bending portion 142 to be within a range of 4 mm to 6 mm (λ/20 to 3λ/40) to widen the band toward the lower frequency side in the antenna device 100 including the non-feed element 140 of the present embodiment, the length of the antenna element 120 may be shortened and the antenna device 100 may be miniaturized.

In the following, VSWR characteristics of the antenna device 100 are described in various cases where the distance from the side edge 131B of the ground element 130B to the portion between the bending portion 142 and the end portion 143 of the non-feed element 140 is changed by adjusting the length between the end portion 141 and the bending portion 142 of the non-feed element 140.

In the exemplary cases described below, it is assumed that the length between the bending portion 142 and the end portion 143 of the non-feed element 140 is fixed at λ/4 (20 mm).

FIGS. 6A-6E are perspective views of the antenna device 100 having the non-feed element 140 arranged at different positions.

Figure 6A:
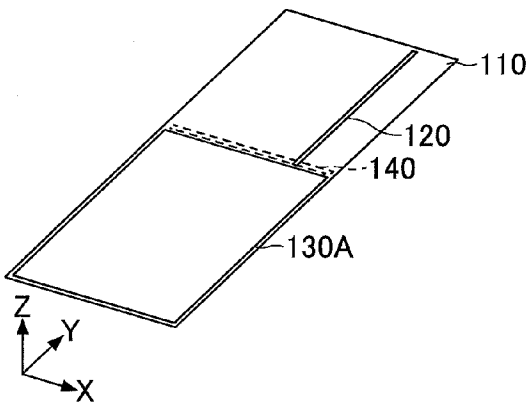
FIGS. 6A-6E are perspective views of the antenna device of the present embodiment having the non-feed element arranged at different positions.
Figure 6B:
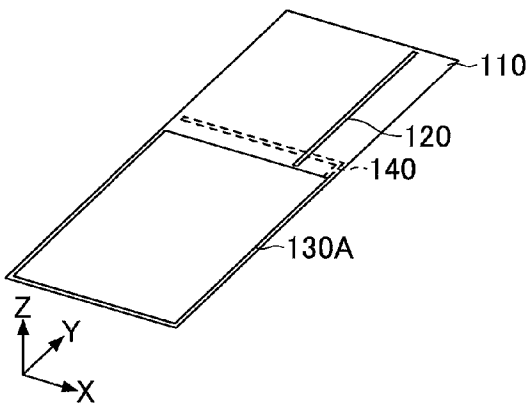
Figure 6C:
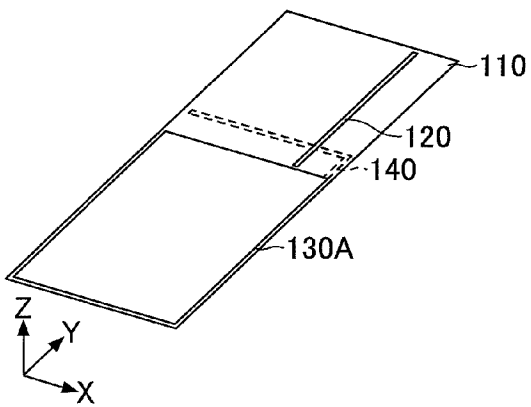

The antenna device 100 illustrated in FIG. 6C corresponds to the antenna device 100 illustrated in FIG. 1. That is, in the antenna device 100 of FIG. 6C, the length between the end portion 141 and the bending portion 142 (see FIG. 2B) is arranged to be λ/4 (20 mm).

In FIGS. 6A and 6B, the portion between the bending portion 142 and the end portion 143 is moved in the Y-axis negative direction so that the length between the end portion 141 and the bending portion 142 (see FIG. 2B) is 2 mm and 1 mm, respectively.

Figure 6D:
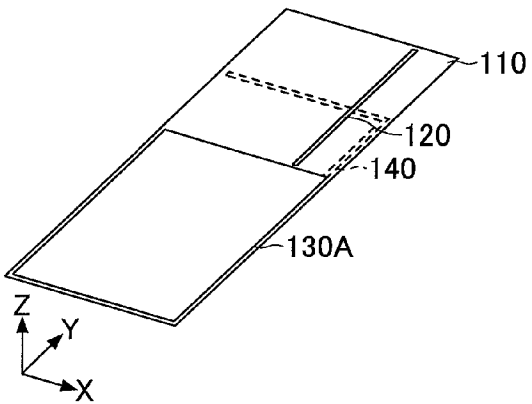
Figure 6E:
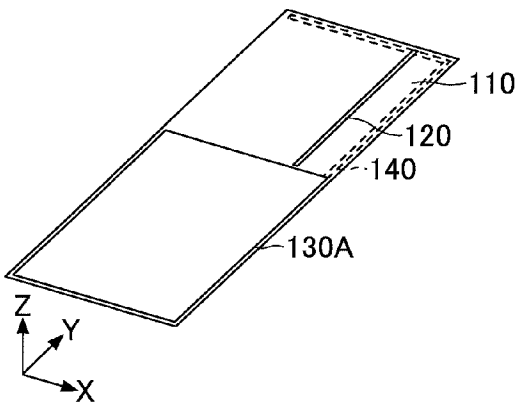

In FIGS. 6D and 6E, the portion between the bending portion 142 and the end portion 143 is moved in the Y-axis positive direction so that the length between the end portion 141 and the bending portion 142 (see FIG. 2B) is 10 mm and 15 mm, respectively.

Figure 7A:
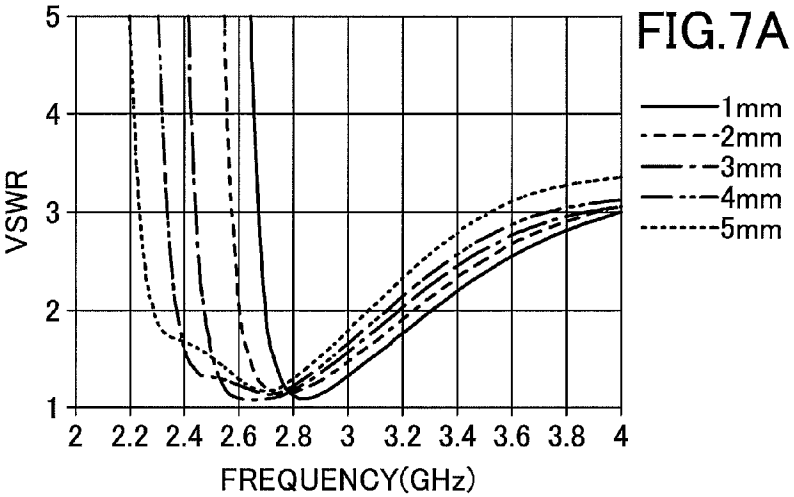
FIGS. 7A-7C are graphs illustrating VSWR characteristics of the antenna device of the present embodiment in various cases where the length between an end portion and a bending portion is changed.
Figure 7B:
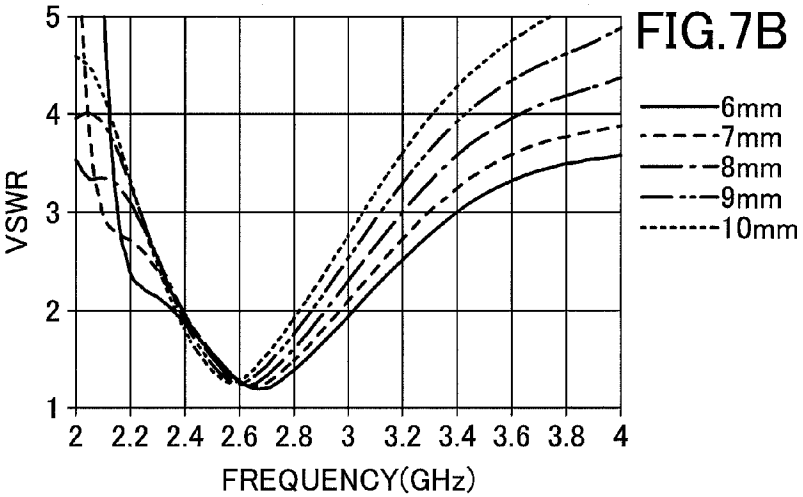
Figure 7C:
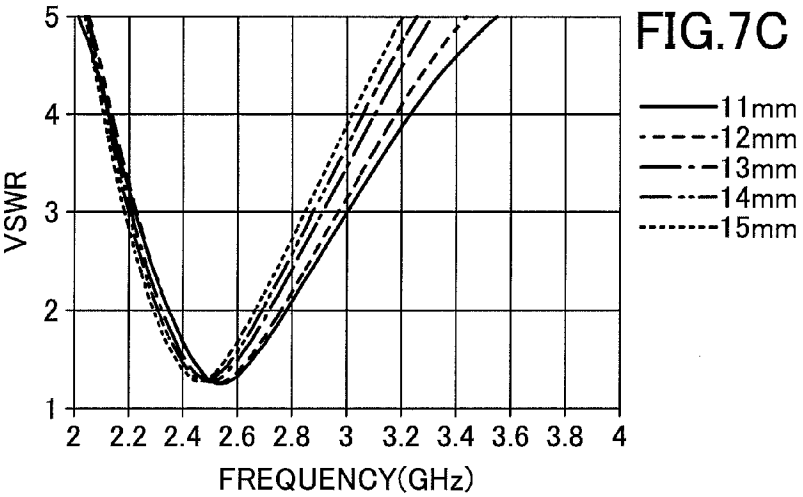

FIGS. 7A-7C are graphs illustrating VSWR characteristics of the antenna device 100 in various cases where the length between the end portion 141 and the bending portion 142 is incremented by 1 mm from 1 mm to 15 mm.

Note that for the sake of improving visibility, the illustrations of the VSWR characteristics in the various cases are divided into separate graphs in FIGS. 7A-7C. That is, FIG. 7A illustrates cases where the length between the end portion 141 and the bending portion 142 is from 1 mm to 5 mm; FIG. 7B illustrates cases where the length between the end portion 141 and the bending portion 142 is from 6 mm to 10 mm; and FIG. 7C illustrates cases where the length between the end portion 141 and the bending portion 142 is from 11 mm to 15 mm.

Upon reviewing the VSWR values at the frequency 2.45 GHz in FIGS. 7A-7C, it can be appreciated that favorable VSWR characteristics can be obtained when the length between the end portion 141 and the bending portion 142 is 3 mm, 4 mm, and 5 mm. Of these cases, the band widening effect is greatest when the length between the end portion 141 and the bending portion 142 is 4 mm.

Note that when the length between the end portion 141 and the bending portion 142 is 6 mm or more, the VSWR value tends to increase and the band tends to become narrower.

As can be appreciated from the above, by arranging the length between the end portion 141 and the bending portion 142 to be within a range of 3 mm to 5 mm in the antenna device 100 of the present embodiment, the band may be widened around the desired frequency of 2.45 GHz and favorable VSWR values may be obtained.

Note that the above range of 3 mm to 5 mm may be expressed as $3\lambda/80$ to $5\lambda/80$ using the wavelength $\lambda$ at the frequency 2.45 GHz, which is approximately 80 mm.

As described above, the VSWR characteristics of the antenna device 100 tend to shift toward the higher frequency side when the length of the antenna element 120 is shortened.

Thus, by arranging the length between end portion 141 and the bending portion 142 to be within a range of 3 mm to 5 mm ($3\lambda/80$ to $5\lambda/80$) to widen the band toward the lower frequency side in the antenna device 100 including the non-feed element 140 of the present embodiment, the length of the antenna element 120 may be shortened and the antenna device 100 may be miniaturized.

In the following, VSWR characteristics of the antenna device 100 are described in various cases where the length between the bending portion 142 and the end portion 143 of the non-feed element 140 is adjusted.

In the exemplary cases described below, it is assumed that the length between the end portion 141 and the bending portion 142 is fixed at $\lambda/20$ (4 mm), and the length between the bending portion 142 and the end portion 143 of the non-feed element 140 is adjusted.

FIGS. 8A-8F are perspective views of the antenna device 100 having the non-feed element 140 adjusted to different lengths.

Figure 8A:
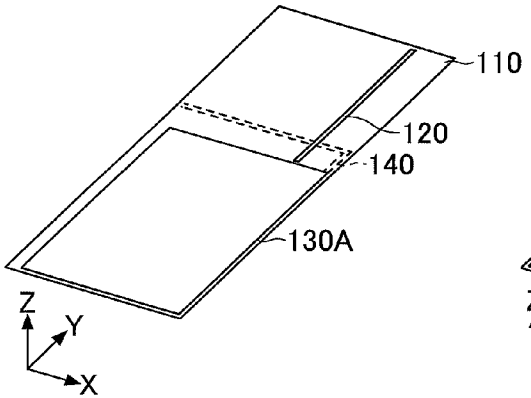
FIGS. 8A-8F are perspective views of the antenna device of the present embodiment having the length of the non-feed element adjusted to different lengths.
Figure 8B:
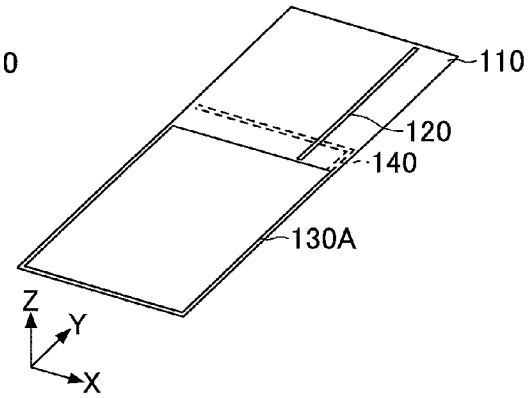
Figure 8C:
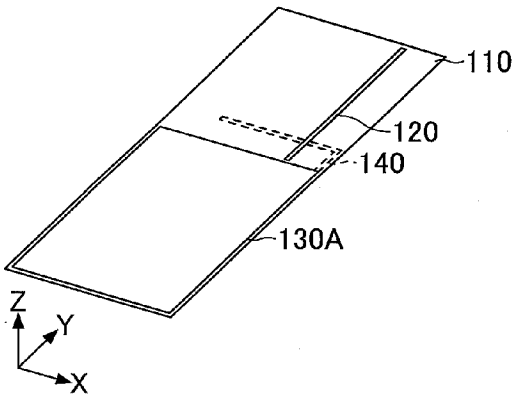
Figure 8D:
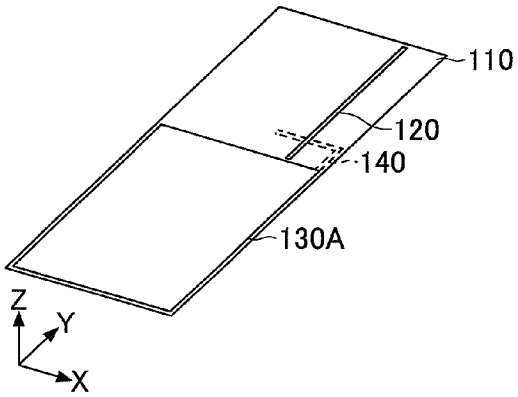
Figure 8E:
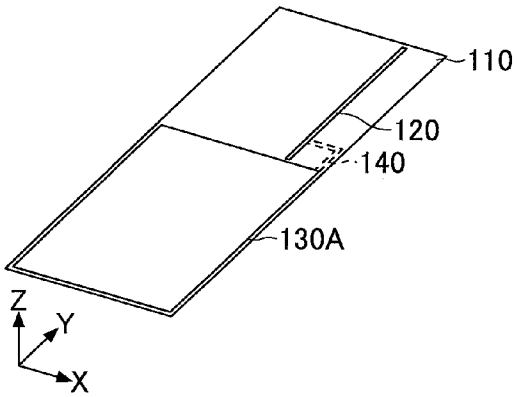
Figure 8F:
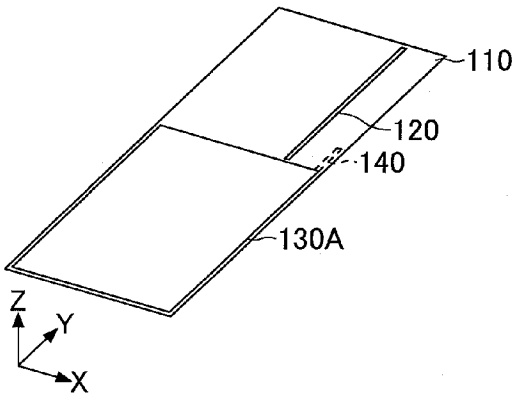

The antenna device 100 illustrated in FIG. 8B corresponds to the antenna device 100 illustrated in FIG. 1. That is, in the antenna device 100 of FIG. 8B, the length between the bending portion 142 and the end portion 143 (see FIG. 2B) is arranged to be $\lambda/4$ (20 mm).

In FIG. 8A, the end portion 143 is extended in the Y-axis negative direction so that the length between the bending portion 142 and the end portion 143 is 21 mm. Note that in conducting electromagnetic simulation of the antenna device 100 in this case, the width of the substrate 110 was widened in the X-axis direction by moving the side edge 110Y1 of the substrate 110 (see FIG. 2A) 1 mm toward the X-axis negative direction side.

In FIGS. 8C, 8D, 8E, and 8F, the end portion 143 is moved in the X-axis positive direction so that the length between the bending portion 142 and the end portion 143 is 15 mm, 10 mm, 5 mm, and 0 mm, respectively.

Figure 9:
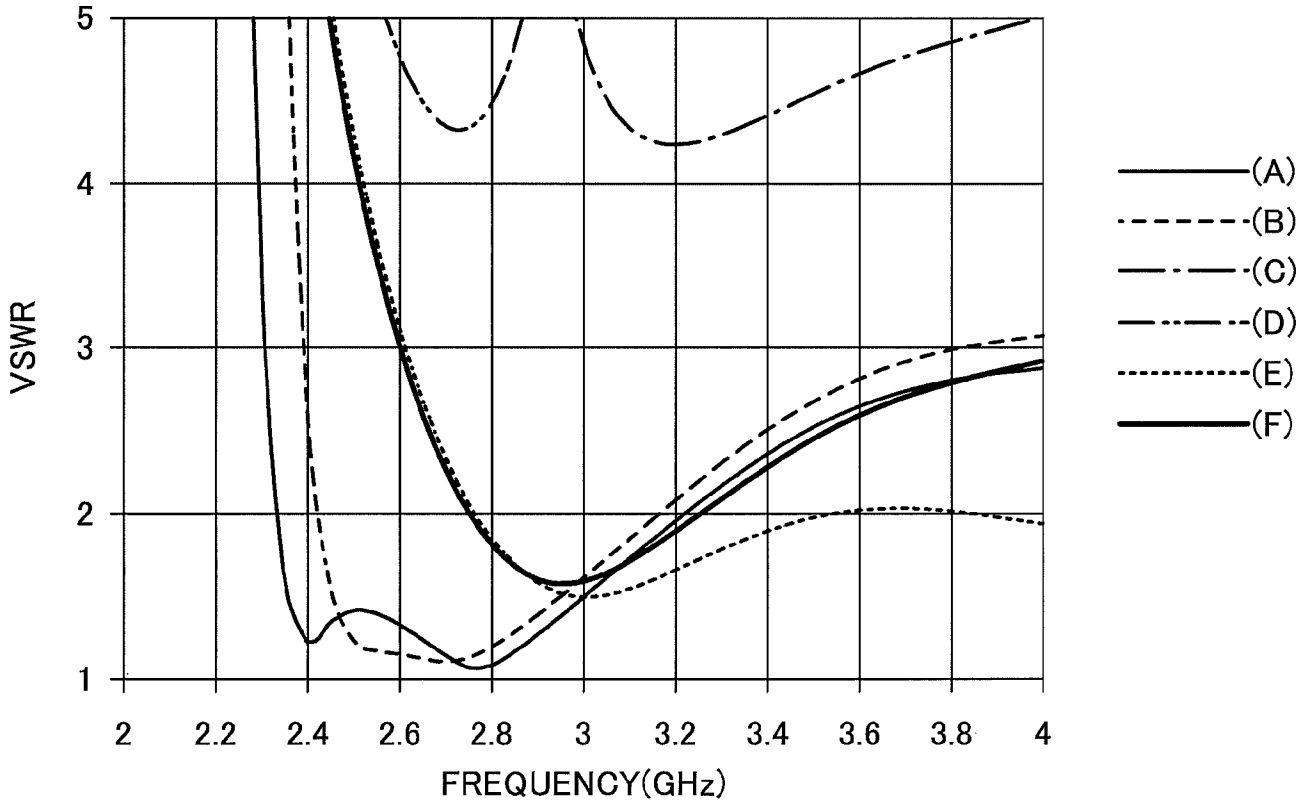
FIG. 9 is a graph illustrating VSWR characteristics of the antenna device of the present embodiment in cases where the length between the bending portion and another end portion of the non-feed element is 21 mm, 20 mm, 15 mm, 10 mm, 4 mm, and 0 mm.

FIG. 9 is a graph illustrating VSWR characteristics of the antenna device 100 in cases where the length between the bending portion 142 and the end portion 143 is set to 21 mm (A), 20 mm (B), 15 mm (C), 10 mm (D), 4 mm (E), and 0 mm (F).

Upon reviewing the VSWR values at the frequency 2.45 GHz in FIG. 9, it can be appreciated that favorable VSWR characteristics can be obtained when the length between the bending portion 142 and the end portion 143 is 21 mm and 20 mm. Of these cases, the VSWR value is lower and more favorable when the length between the bending portion 142 and the end portion 143 is 20 mm.

Also, when the length between the bending portion 142 and the bending portion is 15 mm or less, the VSWR value tends to increase and the band tends to shift toward the higher frequency side.

As can be appreciated from the above, by arranging the length between the bending portion 142 and the end portion 143 to be approximately 20 mm in the antenna device 100 of the present embodiment, the band may be widened around the desired frequency of 2.45 GHz and favorable VSWR values may be obtained.

As described above, the VSWR characteristics of the antenna device 100 tend to shift toward the higher frequency side when the length of the antenna element 120 is shortened.

Thus, by arranging the length between the bending portion 142 and the end portion 143 to be approximately 20 mm to widen the band toward the lower frequency side in the antenna device 100 including the non-feed element 140 of the present embodiment, the length of the antenna element 120 may be shortened and the antenna device 100 may be miniaturized.

In the following, VSWR characteristics of the antenna device 100 are described in various cases where the width of the portion between the bending portion 142 and the end portion 143 of the non-feed element 140 is adjusted.

In the exemplary cases described below, the width of the portion between the bending portion 142 and the end portion 143 is adjusted so that the length between the end portion 141 and the bending portion 142 is shorter than $\lambda/20$ (4 mm).

Figure 10A:
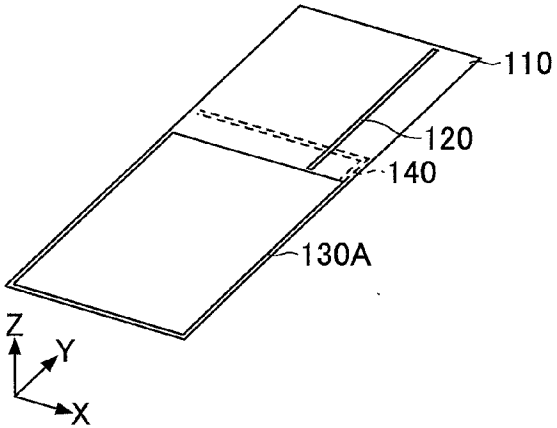
FIGS. 10A-10D are perspective views of the antenna device of the present embodiment having the width of the non-feed element adjusted to different widths.
Figure 10B:
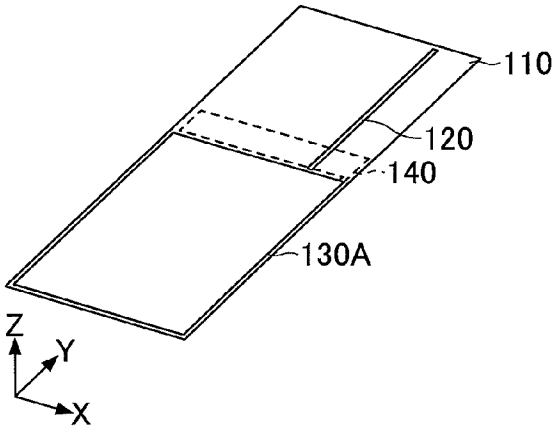
Figure 10C:
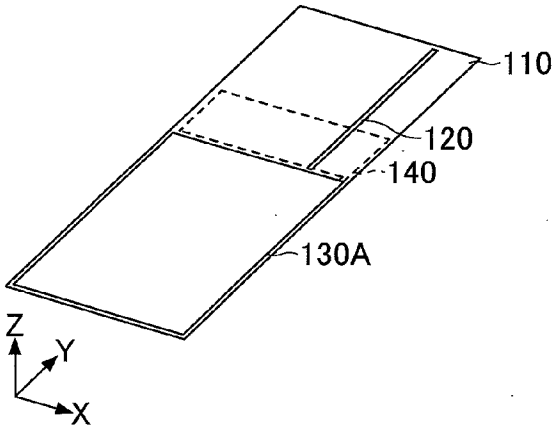

FIGS. 10A-10C are perspective views of the antenna device 100 having the non-feed element 140 adjusted to different widths.

The antenna device 100 illustrated in FIG. 10A corresponds to the antenna device 100 illustrated in FIG. 1. That is, in the antenna device 100 of FIG. 10A, the width of the portion between the bending portion 142 and the end portion 143 (see FIG. 2B) is arranged to be 0.5 mm.

In FIG. 10B, the width of the portion between the bending portion 142 and the end portion 143 is arranged to be 3 mm, and the length of the portion between the end portion 141 and the bending portion 142 is arranged to be 1 mm.

In FIG. 10C, the width of the portion between the bending portion 142 and the end portion 143 is arranged to be 10 mm, and the length of the portion between the end portion 141 and the bending portion 142 is arranged to be 1 mm.

Figure 10D:
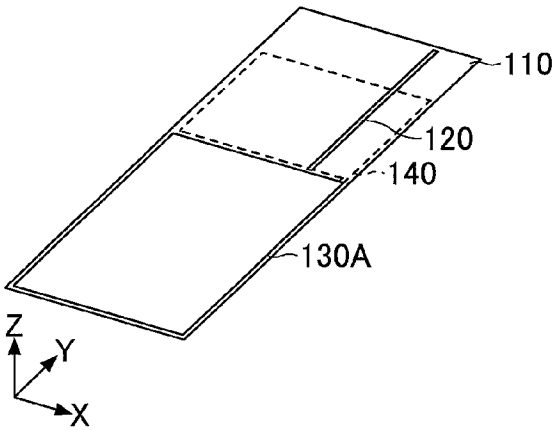

In FIG. 10D, the width of the portion between the bending portion 142 and the end portion 143 is arranged to be 15 mm, and the length of the portion between the end portion 141 and the bending portion 142 is arranged to be 1 mm.

Figure 11:
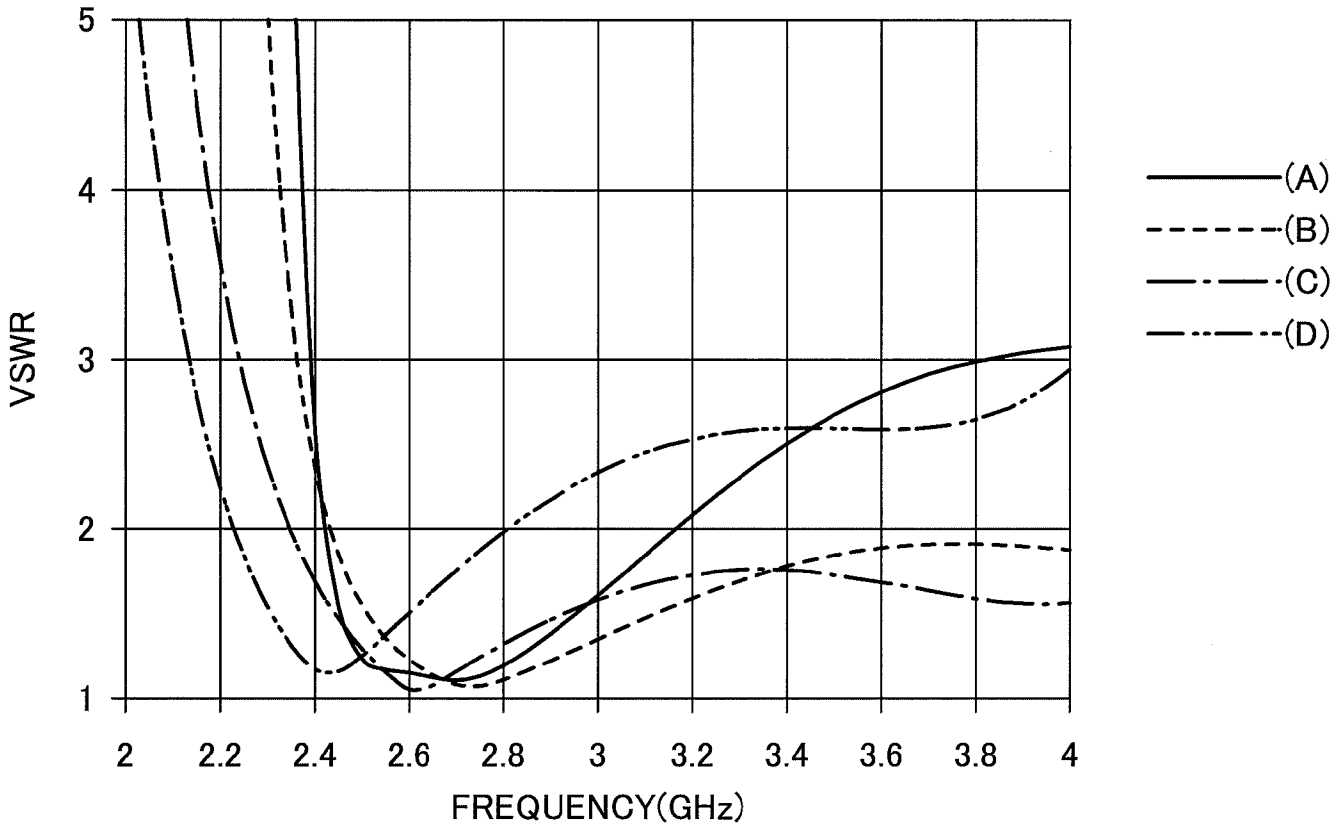
FIG. 11 is a graph illustrating VSWR characteristics of the antenna device of the present embodiment in cases where the width of a portion between the bending portion and the other end portion of the non-feed element is 0.5 mm, 3 mm, 10 mm, and 15 mm.

FIG. 11 is a graph illustrating VSWR characteristics of the antenna device 100 in cases where the width of the portion between the bending portion 142 and the end portion 143 is set to 0.5 mm (A), 3 mm (B), 10 mm (C), and 15 mm (D).

Upon reviewing the VSWR values at the frequency 2.45 GHz in FIG. 11, it can be appreciated that favorable VSWR values of less 2.0 can be obtained at 2.45 GHz in all of the above cases (A)-(D).

Of the above cases, particularly favorable characteristics can be obtained when the width of the portion between the bending portion 142 and the end portion 143 is 0.5 mm.

As can be appreciated from the above, by arranging the width of the portion between the bending portion 142 and the end portion 143 to be 0.5 mm in the antenna device 100 of the present embodiment, the band may be widened around the desired frequency of 2.45 GHz and favorable VSWR values may be obtained.

As described above, the VSWR characteristics of the antenna device 100 tend to shift toward the higher frequency side when the length of the antenna element 120 is shortened.

Thus, by arranging the width of the portion between the bending portion 142 and the end portion 143 to be approximately 0.5 mm to widen the band toward the lower frequency side in the antenna device 100 including the non-feed element 140 of the present embodiment, the length of the antenna element 120 may be shortened and the antenna device 100 may be miniaturized.

According to an aspect of the present embodiment, the antenna device 100 may be miniaturized by arranging the non-feed element 140 and the antenna element 120 in the manner described above.

Note that although the antenna device 100 includes two ground elements 130A and 130B in the above-described embodiment, the antenna device 100 may alternatively include only one of the ground element 130A or the ground element 130B.

For example, in a case where the antenna device 100 only includes the ground element 130A, the end portion 141 of the non-feed element 140 may be connected to the ground element 130A by a via that penetrates through the substrate 110.

In a case where the antenna device 100 only includes the ground element 130B, the shield line of a coaxial cable may be connected to the ground element 130B by a via that penetrates through the substrate 110, for example.

Also, in the antenna device 100 described above, the antenna element 120 and the ground element 130A are arranged on one surface of the substrate 110 and the non-feed element 140 and the ground element 130B are arranged on the other surface of the substrate 110.

However, the antenna element 120, the ground elements 130A and 130B, and the non-feed element 140 do not necessarily have to be arranged on one surface and the other surface of the substrate 110 as long as their plan-view positional relationship is maintained.

For example, in certain embodiments, the substrate 110 may be a multilayer substrate including a conductive inner layer. In this case, the antenna element 120, the ground elements 130A and 130B, and the non-feed element 140 may be arranged on the front surface, the back surface or an inner layer of the substrate 110.

Figure 12:
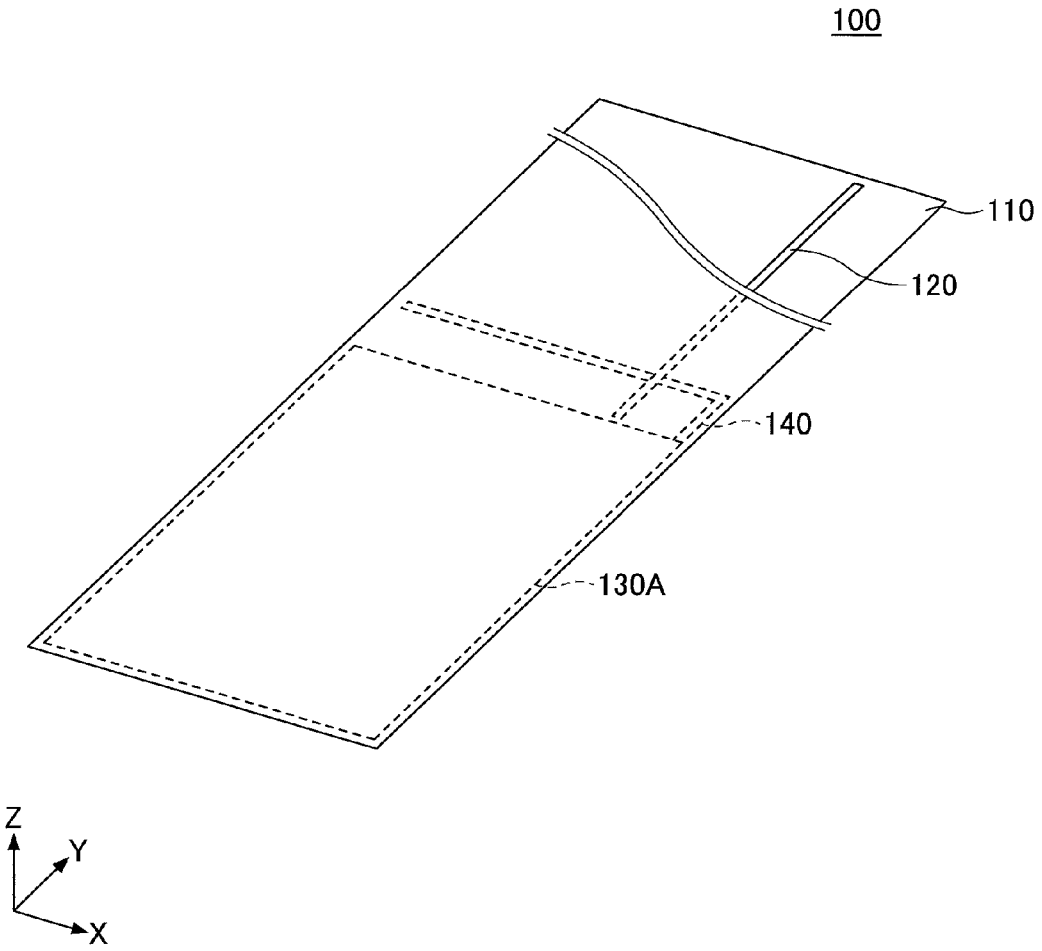
FIG. 12 is a perspective view of an antenna device according to another embodiment of the present invention.

FIG. 12 illustrates an exemplary configuration of an antenna device with the substrate 110 having a multilayer structure. In FIG. 12, the antenna element 120 is arranged on an inner layer of the substrate 110. Note that in FIG. 12, the inner layer of the substrate 110 is illustrated at an upper portion above the section line drawn across the substrate 110 where the antenna element 120 is indicated by a solid line. At the portion below this section line, the inner layer is covered by a top layer of the substrate 110, and the corresponding positions of the antenna element 120 and the ground element 130A are indicated by broken lines.

In the case where the substrate 110 is a multilayer substrate, vias that penetrate through an insulating layer of the multilayer substrate may be used to establish electrical connection between the antenna element 120, the ground elements 130A and 130B, and the non-feed element 140, for example.

Also, in the above case, the antenna device 100 may include only one of the ground element 130A or the ground element 130B, for example.

Also, although the end portion 141 of the non-feed element 140 is connected to the corner portion 130B1 of the ground element 130B in the above-described embodiment, the present invention is not limited to such an arrangement and the end portion 141 may be grounded at some other location.

For example, in the case where the antenna device 100 includes only the ground element 130A, the position of the end portion 141 of the non-feed element 140 may be extended in the Y-axis negative direction from the position illustrated in FIGS. 2A and 2B. In this case, the non-feed element 140 may be connected to the ground element 130A at the position of the end portion 141 illustrated in FIG. 2B by a via that penetrates through the substrate 110, for example.

Also, in the above-described embodiment, the feed point 121 at one end of the antenna element 120 is arranged near the side edge 131A of the ground element 130A, and the side edge 130A is linear. However, in other embodiments, a concave portion may be provided at the side edge 131A by notching the side edge 131A in the Y-axis negative direction, and the feed point 121 may be drawn into this concave portion, for example. Such an arrangement may be advantageous in a case where a coaxial cable is used to feed the feed point 121, for example.

Further, although the antenna device of the present invention is described above with respect to certain illustrative embodiments, the present invention is not limited to these embodiments but encompasses numerous other variations and modifications that may be made without departing from the scope of the present invention.

The present application is based on and claims priority to Japanese Patent Application No. 2012-276101 filed on Dec. 18, 2012, the entire contents of which are hereby incorporated by reference.

What is claimed is:

1. An antenna device comprising:

a substrate;

a first ground element that is arranged on the substrate;

an antenna element that is arranged on the substrate and extends from its first end positioned near a side edge of the first ground element to its second end positioned away from the side edge; and a non-feed element that is arranged on the substrate, connected to the first ground element, and insulated from the antenna element;

wherein the non-feed element extends from its first end portion positioned near the side edge of the first ground element to a bending portion in a direction away from the side edge and extends from the bending portion to its second end portion along the side edge; and wherein a portion between the bending portion and the second end portion of the non-feed element intersects with the antenna element.

2. The antenna device as claimed in claim 1, wherein the non-feed element is connected to the first ground element at the first end portion.

3. The antenna device as claimed in claim 1, wherein the non-feed element is arranged on one of a front surface, a back surface, or an inner layer of the substrate; and the antenna element is arranged on another one of the front surface, the back surface, or the inner layer of the substrate.

4. The antenna device as claimed in claim 1, wherein a length between the bending portion and an intersection point at which the antenna element and the non-feed point intersect is arranged to be 1/20 to 3/40 of a wavelength λ.

5. The antenna device as claimed in claim 1, wherein a length between the bending portion and the second end portion of the non-feed element is arranged to be 3/80 to 5/80 of a wavelength λ.

6. The antenna device as claimed in claim 1, further comprising:

a second ground element that is arranged on the substrate;

wherein the first ground element and the antenna element are arranged on one of a front surface, a back surface, or an inner layer of the substrate; and the second ground element and the non-feed element are arranged on another one of the front surface, the back surface, or the inner layer of the substrate.

* * * * *